US006513733B1

(12) United States Patent
Lambert

(10) Patent No.: US 6,513,733 B1
(45) Date of Patent: Feb. 4, 2003

(54) FUEL INJECTION AND METHOD OF ASSEMBLING A FUEL INJECTOR

(75) Inventor: Malcolm David Dick Lambert, Bromley (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/599,584

(22) Filed: Jun. 22, 2000

(30) Foreign Application Priority Data

Jun. 24, 1999 (GB) ..... 9914642

(51) Int. Cl.[7] ..... B05B 1/30; B05B 1/34; B05B 1/00; F02M 59/00; F02D 1/06

(52) U.S. Cl. ..... 239/533.1; 239/533.2; 239/585.5; 239/600; 239/5

(58) Field of Search ..... 239/533.1, 533.2, 239/533.3, 533.7, 533.9, 533.11, 533.12, 584, 585.1, 585.2, 585.3, 585.4, 585.5, 600, 5, 124

(56) References Cited

U.S. PATENT DOCUMENTS 4,405,082 A * 9/1983 Walter et al. ..... 239/91
5,275,341 A * 1/1994 Romann et al. ..... 239/585.4
5,458,292 A * 10/1995 Hapeman ..... 239/533.4
5,533,672 A * 7/1996 Peters ..... 239/88
5,655,715 A * 8/1997 Hans et al. ..... 239/408
5,899,389 A * 5/1999 Pataki et al. ..... 239/533.2
5,944,262 A * 8/1999 Akutagawa et al. ..... 239/585.4
5,947,389 A * 9/1999 Hasegawa et al. ..... 239/533.2
6,089,475 A * 7/2000 Reiter et al. ..... 239/585.1
6,189,817 B1 * 2/2001 Lambert ..... 239/533.2
6,260,775 B1 * 7/2001 Lambert et al. ..... 239/533.3

* cited by examiner

*Primary Examiner*—Michael Mar
*Assistant Examiner*—Davis Hwu
(74) *Attorney, Agent, or Firm*—Thomas N. Twomey

(57) ABSTRACT

A fuel injector comprising a nozzle body having a first bore defining first and second seatings and an outer valve member slidable within the first bore and engageable with the first seating to control fuel flow from a first outlet opening located downstream of the first seating. The outer valve member is provided with a through bore and an inner valve member is slidable within the through bore and is engageable with a second seating to control fuel flow from a second outlet opening. The through bore defines a step which is engageable with an enlarged region of the inner valve member, the through bore permitting, during fuel injector assembly, insertion of the inner valve member into the through bore through an end of the through bore remote from the first and second outlet openings. The invention also relates to a method of assembling such a fuel injector.

15 Claims, 7 Drawing Sheets

FUEL INJECTION AND METHOD OF ASSEMBLING A FUEL INJECTOR

TECHNICAL FIELD

This invention relates to a fuel injector for use in supplying fuel, under pressure, to a combustion space of a compression ignition internal combustion engine. The invention also relates to a method of assembling a fuel injector.

BACKGROUND OF THE INVENTION

In order to reduce emissions levels, it is known to provide fuel injectors in which the total area of the openings through which fuel is delivered can be varied, in use. One technique for achieving this is to use two valve needles, one of which is slidable within a bore provided in the other of the needles to control the supply of fuel to some of the outlet openings independently of the supply of fuel to others of the outlet openings. However, such arrangements have the disadvantage that fuel may be able to flow between the inner and outer needles giving rise to substantially continuous delivery of fuel at a low rate.

European patent application EP 99304430.4 describes a dual valve needle fuel injector which overcomes this problem. The outer valve needle is provided with a bore within which a sleeve is located to retain an inner valve within the bore. The inner surface of the sleeve and the outer surface of the inner valve needle together define a clearance passage for fuel which enables sliding movement of the inner valve needle. The dimensions of the clearance passage determine the rate at which fuel is supplied to and from a fuel chamber upstream of the inner valve needle, defined by the bore and an upper end surface of the inner valve needle.

Fuel flow through the clearance passage exerts pressure on the sleeve and, thus, the sleeve can adopt a non-circular shape. This can change the fuel flow characteristics of the injector and may cause the inner valve needle to become stuck. However, if the clearance passage is too large and fuel leaves the fuel chamber too quickly, a cavity can form in the chamber which adversely affects the performance of the fuel injector. Thus, it is difficult to manufacture a fuel injector of this type without compromising the fuel injector performance in some way. Furthermore, it is difficult to manufacture the sleeve component of the fuel injector as its dimensions are small.

SUMMARY OF THE INVENTION

It is an object of the present invention to alleviate one or more of the aforementioned problems associated with the prior art.

According to a first aspect of the present invention there is provided a fuel injector comprising a nozzle body having a first bore defining first and second seatings, an outer valve member, slidable within the first bore and engageable with the first seating to control fuel flow from a first outlet opening located downstream of the first seating, the outer valve member being provided with a through bore, an inner valve member, slidable within the through bore and engageable with the second seating to control fuel flow from a second outlet opening, the through bore defining a step engageable with an enlarged part of the inner valve member, the through bore permitting, during fuel injector assembly, insertion of the inner valve member into the through bore through an end of the through bore remote from the first and second outlet openings.

The fuel injector in accordance with the present invention can be manufactured conveniently. As the through bore extends along the complete length of the outer valve member, the inner valve member can be inserted into the through bore through the upper end thereof. In known fuel injectors, the bore in the outer valve member only extends along a part of the length of the outer valve member. It is therefore necessary to assemble the fuel injector by inserting the inner valve member into the bore through the lower end of the valve member.

Preferably, the outer valve member includes a radially extending enlarged region which cooperates with a part of the first bore to guide axial movement of the outer valve member within the bore such that the outer valve member remains substantially concentric within the bore throughout axial movement.

In one embodiment of the invention, the fuel injector includes an upper, sealing member which is received in the upper end of the through bore, the sealing member being in sealing engagement with the through bore to prevent fuel discharge from the through bore through the upper end thereof at undesirable stages in the operating cycle.

In an alternative embodiment, the fuel injector includes vent means for permitting fuel upstream of the inner valve member to vent from the through bore.

Conveniently, the vent means may include an upper valve member slidably mounted within the upper end of the through bore, the through bore defining a valve seat for the valve member, the valve member being exposed to fuel pressure within a chamber defined within the through bore between the inner valve member and the upper valve member, whereby movement of the upper valve member away from the valve seat due to fuel pressure within the chamber permits fuel to vent from the chamber.

This provides the advantage that high pressure fuel does not become trapped within the chamber during fuel injector operation. Trapping of fuel within the chamber may otherwise degrade fuel quality and, hence, fuel injector performance. Conveniently, the upper valve member may be provided with flats or slots to increase the flow area for fuel venting from the chamber.

The upper valve member may be provided with resilient bias means, for example a compression spring, to bias the upper valve member into the valve seat. In this way, when the fuel injector is not being supplied with fuel, a substantially fluid tight seal is formed between the chamber and the upper valve member to prevent any residual fuel venting from the chamber.

The outer valve member may be provided with a guide member, coaxial with the outer valve needle, which serves to guide axial movement of the outer valve member within the first bore. The guide member may be integrally formed with the outer valve member.

The upper valve member may be spaced apart from the chamber by a spacer member such that the valve member is located towards an upper end of the through bore. This simplifies manufacture of the fuel injector.

According to a second aspect of the present invention, there is provided a method of assembling a fuel injector including the steps of;

- providing a nozzle body having a first bore formed therein,
- providing an outer valve member having a through bore formed therein, the through bore defining a step engageable with an enlarged part of an inner valve member to be received within the through bore, inserting the inner valve member in the upper end of the through bore, inserting an upper member in the upper end of the through bore, and inserting the outer valve member, having the inner valve member and the upper member inserted therein, into the upper end of the first bore.

The upper member may be an upper valve member which permits fuel upstream of the inner valve member to vent from the through bore.

Fuel injector assembly can therefore be achieved conveniently by assembling each of the component parts separately prior to assembly of the fuel injector.

BRIEF DESCRIPTION OF THE DRAWINGS

The invention will now be described, by way of example only, with reference to the following figures in which.

DESCRIPTION OF THE PREFERRED EMBODIMENT

Figure 1:
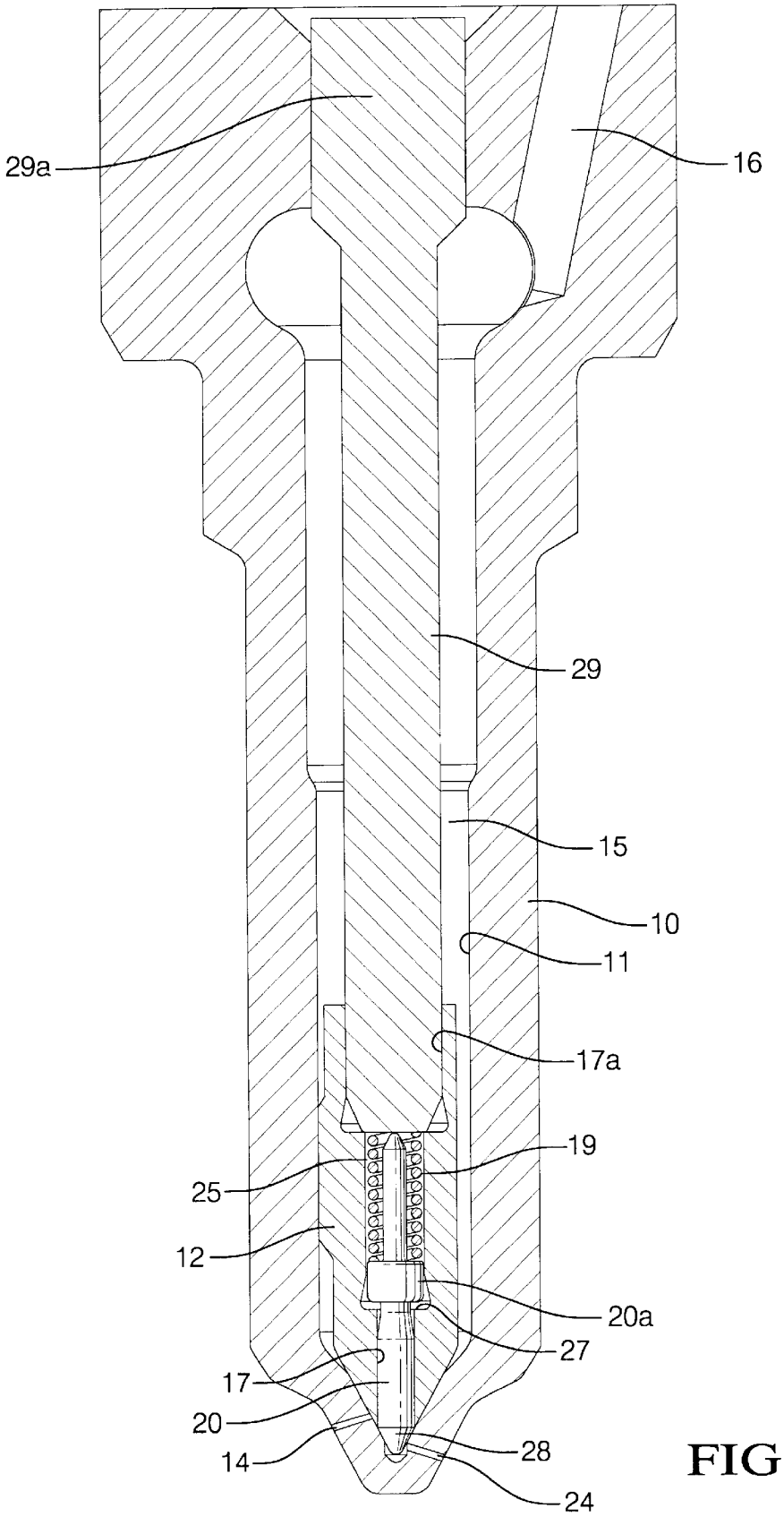
FIG. 1 is a sectional view of a fuel injector in accordance with a first embodiment of the present invention.
Figure 2:
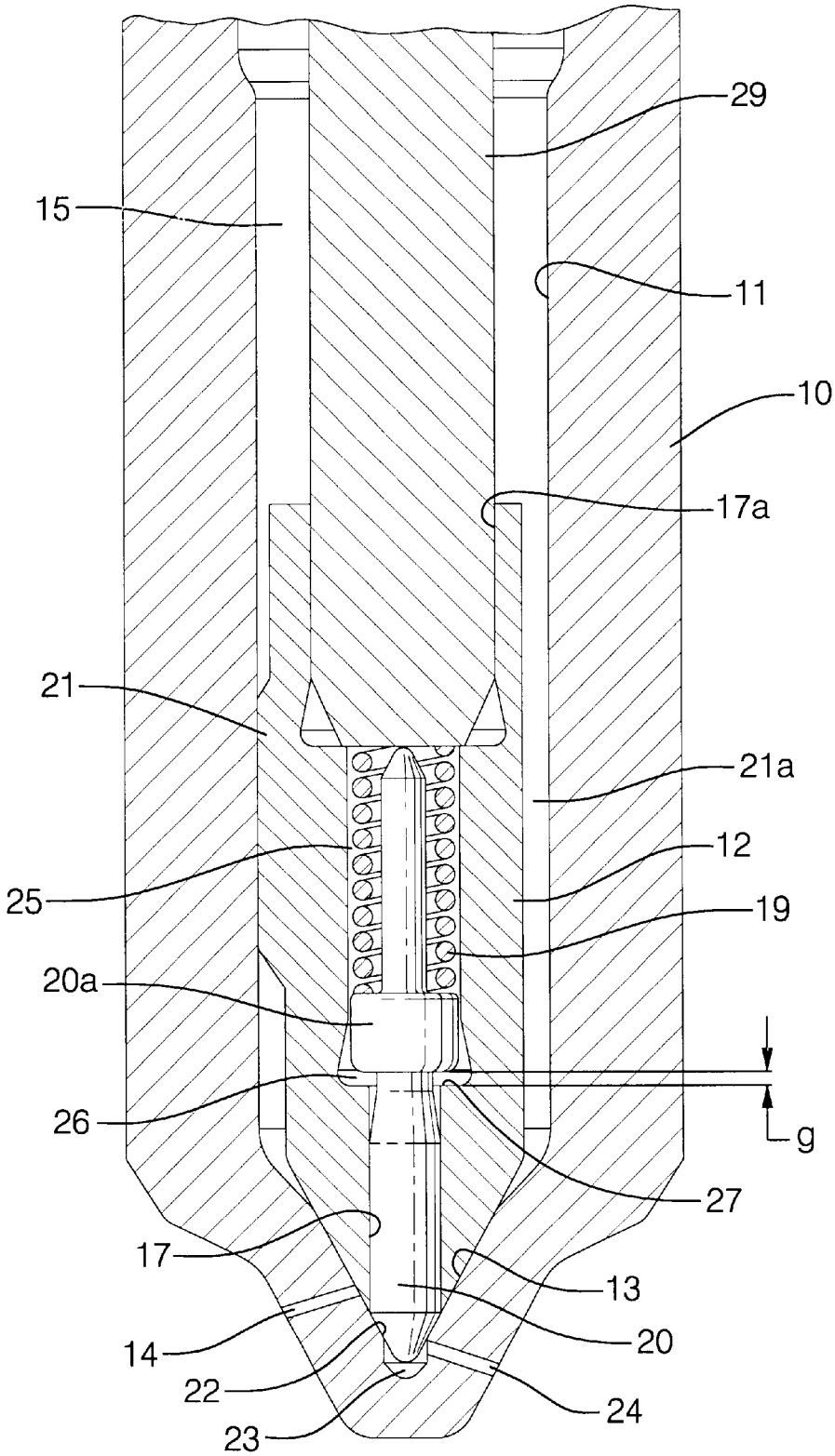
FIG. 2 is an enlarged sectional view of the end of the fuel injector shown in FIG. 1.

Referring to FIGS. 1 and 2, a fuel injector includes a nozzle body 10 having a blind bore 11 formed therein. The blind end of the bore 11 is shaped to be of frusto-conical form and defines a seating surface with which an outer valve needle 12 is engageable, the outer valve needle 12 engaging the seating surface at a first seating 13 which is located upstream of a first set of outlet openings 14 (only one of which is shown). The valve needle 12 and bore 11 together define a delivery chamber 15 which communicates with a source of fuel at high pressure by means of a drilling 16 provided in an upper part of the nozzle body 10. The outer valve needle 12 cooperates with the first seating 13 to control communication between the delivery chamber 15 and the first outlet opening 14.

The outer valve needle 12 is moveable within the bore 11 under the control of an appropriate control arrangement (not shown) which controls the distance through which the needle 12 can move away from the first seating 13. The control arrangement may comprise, for example, a piezoelectric actuator arrangement which includes a piezoelectric actuator element or stack.

The outer valve needle 12 is provided with a bore 17,17*a* extending through the length of the valve needle 12 and having an enlarged diameter 17*a* at its upper end. An inner valve needle 20, having an enlarged diameter region 20*a* at its upper end, is slidably mounted within the bore 17 and is engageable with a second seating 22 to control fuel delivery from a second set of outlet openings 24 (only one of which is shown). The enlarged diameter region of the bore 17*a* defines a chamber 25 housing a spring 19. The spring 19 is in engagement with the enlarged diameter region 20*a* of the inner valve needle 20 and biases the inner valve needle 20 towards a position in which the inner valve needle 20 seats against the second seating 22.

The spring 19 abuts, at its end remote from the inner valve needle 20, a sealing member 29 forming an interference fit with the bore 17*a*. The interference fit between the sealing member 29 and the bore 17*a* forms a substantially fluid tight seal such that fuel in the chamber 25 cannot escape past the seal. The fluid tight seal also benefits from fuel pressure in the delivery chamber 15 which increases the contact pressure between the outer surface of the sealing member 29 and the bore 17*a*. This increased contact pressure also serves to improve the axial load carrying capability of the sealing member 29 and the outer valve needle 12.

As can be seen in FIG. 1, the sealing member 29 has an upper end region 29*a* having an enlarged diameter. Cooperation between the enlarged region 29*a* and the adjacent part of the bore 11 forms a substantially fluid tight seal and also serves to guide the sealing member 29 for axial movement within the bore 11. The diameter of the sealing member 29 below the enlarged region 29*a* is greater than the diameter of the bore 11 at the first seating 13. Thus, unnecessary axial loading on the seal between the sealing member 29 and the bore 17*a* of the outer valve needle 12 is avoided.

The bore 17 defines, with an outer surface of the inner valve needle 20, an annular chamber 26. The bore 17 also defines a step 27 which is engageable with the enlarged region 20*a* of the inner valve needle 20 such that, upon movement of the outer valve needle 12 away from the first seating 13 by an amount equal to a clearance gap, g, the step 27 moves into engagement with the enlarged region 20*a* of the inner valve needle 20. Movement of the outer valve needle 12 away from the first seating 13 by an amount less than or equal to the clearance gap, g, causes the outer valve needle 12 to lift away from the first seating 13, whilst the inner valve needle 20 remains seated. Movement of the outer valve needle 12 by an amount greater than the clearance gap, g, causes movement of the outer valve needle 12 to be transmitted to the inner valve needle 20, as the step 27 engages the enlarged region 20*a*, thereby also causing the inner valve needle 20 to lift away from the second seating 22.

The lower end of the inner valve needle 20 has a tip portion 28 of frusto-conical form which extends into a sac 23 of relatively small volume. A narrow clearance is defined between the inner valve needle 20 and the outer valve needle 12, the clearance passage permitting fuel to flow between the sac 23 and the chamber 25. Fluid communication between the chamber 25 and the sac 23 ensures that movement of the inner valve needle 20 relative to the outer valve needle 12 can occur, and that the fuel pressure in the chamber 25, exposed to the upper end of the inner valve needle 20, is substantially the same as the fuel pressure within the sac 23.

As the enlarged region 20*a* of the inner valve needle 20 and the bore 17 define the clearance gap, g, in the annular chamber 26, the clearance gap, g, retains a substantially constant size during the service life of the fuel injector. In known fuel injectors, in which an upper end of a sleeve defines the clearance gap, the clearance gap is prone to vary in size during fuel injector service life.

The outer valve needle 12 has an enlarged region 21, having substantially the same diameter as the bore 11, extending radially from one section of the outer valve needle 12. Cooperation between the enlarged region 21 of the outer valve needle 12 and the bore 11 serves to guide the outer valve needle 12 during axial movement and ensures that the outer valve needle 12 remains concentric with the nozzle body 10. The outer valve needle 12 may be provided with flats or slots 2 la on the outer surface to permit fuel in the delivery chamber 15 to flow past the enlarged region 21.

In use, the injector is arranged such that the delivery chamber 15 is connected to a source of fuel under high pressure, for example the common rail of a common rail fuel system, the common rail being charged to a high pressure by an appropriate high pressure fuel pump. Prior to commencement of injection, the actuator arrangement is operated in such a manner that the outer valve needle 12 engages the first seating 13. As a result, communication between the delivery chamber 15 and the sac 23 is not permitted. At this stage, the spring 19 biases the inner valve needle 20 into engagement with the second seating 22. Fuel cannot flow past the first seating 13 and fuel injection does not take place.

When injection is to commence, the actuator arrangement is operated in such a manner that the sealing member 29 and the outer valve needle 12 are moved in an upwards direction, lifting the outer valve needle 12 away from the first seating 13. Lifting may be aided by the action of the fuel under high pressure within the delivery chamber 15 acting upon the angled surface of the outer valve needle 12 adjacent the seating 13. Upward movement of the outer valve needle 12 permits fuel to flow from the delivery chamber 15 past the first seating 13. As fuel flows past the first seating 13 it is also able to flow through the first outlet opening 14 and fuel is delivered into the engine cylinder.

Provided the outer valve needle 12 only moves through a small distance, the step 27 does not move into engagement with the inner valve needle 20 and the inner valve needle 20 remains in engagement with the second seating 22 under the action of the spring 19 and the fuel pressure within the chamber 25. As a result, fuel is unable to flow past the second seating 22 into the sac 23 and through the second outlet opening 24. It will be appreciated that, as fuel is only injected through the first outlet opening 14, injection of fuel occurs at a relatively low rate for a given applied fuel pressure.

When fuel is to be injected at a higher rate for a given fuel pressure, the sealing member 29 and the outer valve needle 12 are moved through a further distance, further movement of the outer valve needle 12 resulting in the step 27 moving into engagement with the enlarged diameter region 20*a* of the inner valve needle 20. Movement of the outer valve needle 12 is therefore transmitted to the inner valve needle 20 and the inner valve needle 20 lifts away from the second seating 22. As a result, fuel is able to flow from the chamber 15 into the sac 23 and through the second outlet opening 24. As fuel is delivered through both the first outlet opening 14 and the second outlet opening 24, it will be appreciated that fuel is delivered at a relatively high rate for a given fuel pressure.

In order to terminate injection, the actuator is de-actuated such that the outer valve needle 12 is returned to the position illustrated in which it engages the first seating 13. It will be appreciated that prior to engagement of the outer valve needle 12 with the first seating 13, the inner valve needle 20 moves into engagement with the second seating 22. It will therefore be appreciated that termination of injection through the second outlet opening 24 occurs prior to termination of injection through the first outlet opening 14. When the inner valve needle 20 returns into engagement with the first seating 13, the injector still contains a quantity of fuel within the sac 23 which is able to be delivered through the second outlet opening 24, thus termination of injection may not occur immediately. However, as the sac 23 has only a relatively small volume, this effect is acceptable for many applications.

In an alternative embodiment, the sealing member 29 may be connected to the outer valve needle 12 by means of threading or welding. However, further machining of the enlarged region 21 of the outer valve needle 12 may then be required to ensure adequate concentricity is maintained between the bore 11 and the valve needle 12.

Manufacture of the fuel injector in accordance with the present invention is simplified as the valve needles 12,20 can be fully manufactured prior to assembly of the fuel injector. As the through bore 17 extends through the outer valve needle 12, the fuel injector can be assembled by first inserting the inner valve needle 20 and the spring 19 and then the sealing member 29 into the upper end of the outer valve needle 12. This assembly can then be inserted into the bore 11 through the upper end of the nozzle body 10 to completely assemble the fuel injector.

A possible disadvantage of the embodiment shown in FIGS. 1 and 2 is that the chamber 25 contains fuel which is periodically pressurized and then depressurized during operation of the fuel injector, thereby heating the fuel. Fuel within the chamber 25 does not move substantially during operation of the injector and, as fuel can reach temperatures in excess of 250° C., fuel degradation may occur.

Figure 3:
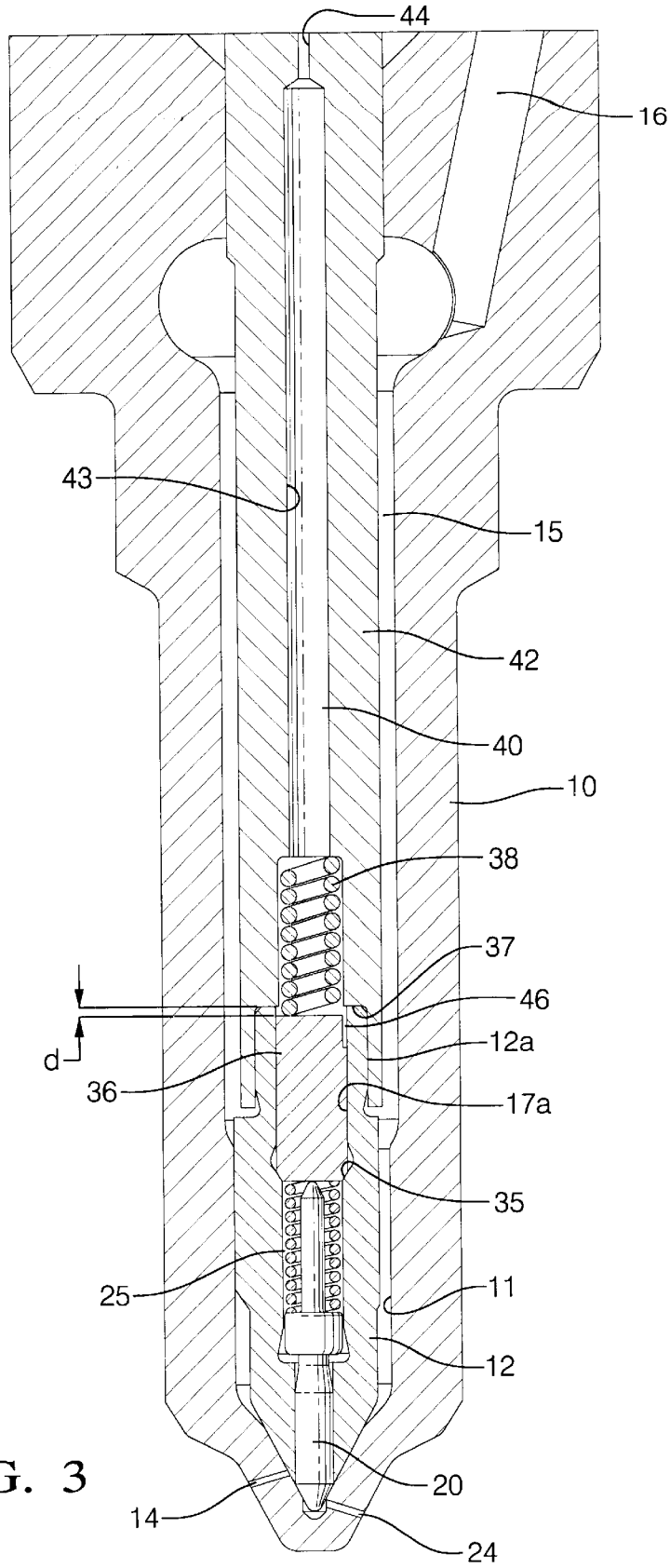
FIGS. 3–6 are alternative embodiments to that shown in FIG. 1.

An alternative embodiment of the invention which overcomes this problem is shown in FIG. 3. Like parts to those shown in FIGS. 1 and 2 are referred to with like reference numerals. In this embodiment of the invention, an upper valve member 36 is slidably mounted within the bore 17*a*, the lower end face of the valve member 36 defining the upper surface of the chamber 25. The upper end 12*a* of the outer valve needle 12 is of reduced diameter and a guide member 42, provided with a bore 43, engages the upper end 12*a* in an interference fit. The upper end of the valve member 36 engages a compression spring 38 which is housed within an axial chamber 40 defined within the bore 43. A valve seating 35 is defined by the bore 17, the valve member 36 being biased against the seating 35 by means of the spring 38, thereby ensuring that a fluid tight seal is maintained between the chamber 25 and the axial chamber 40 when there is a negligible difference in fuel pressure between the two chambers. The bore 41 of the guide member 42 defines a step 37 with which the upper end face of the valve member 36 is engageable.

A narrow passage 44 may be provided at the upper end of the guide member 42 in communication with the axial chamber 40 to permit the effective volume of the axial chamber 40 to be varied for optimum performance of the fuel injector.

A narrow clearance is defined between the upper valve member 36 and the bore 17*a* such that fuel in the chamber 25 can communicate with the axial chamber 40 when the valve member 36 is moved away from its seating 35. The upper valve member 36 is provided with flats or slots 46 to increase the fuel flow area between the chambers 25,40 during fuel injector operation.

The guide member 42 is controlled by means of an actuator arrangement such as, for example, a piezoelectric actuator arrangement. The guide member 42 is biased by means of a spring (not shown) in a downwards direction, thereby ensuring that the outer valve needle 12 is seated against the first seating 13 prior to fuel injector operation.

In order to commence fuel injection, the guide member 42 is lifted in an upwards direction by the actuator arrangement. When the guide member 42 is lifted in an upwards direction by an amount less than or equal to the clearance gap, g, this causes the outer valve needle 12 to be lifted away from the first seating 13 whilst the inner valve needle 20 remains seated against the second seating 22. The fuel in the delivery chamber 15 is able to flow past the first seating 13 and is ejected from the first outlet opening 14 into the engine. In addition, fuel may flow through a narrow clearance between the inner valve needle 20 and the outer valve needle 12 into the chamber 25, thereby causing fuel pressure within the chamber 25 to increase. Fuel pressure within the chamber 25 acts on the valve member 36, and if fuel pressure within the chamber 25 exceeds fuel pressure within the axial chamber 40, the valve member 36 is moved in an upwards direction, away from the valve seating 35, against the action of the spring 38. Thus, the fluid tight seal between the valve member 36 and the chamber 25 is broken and fuel is able to flow from the chamber 25 to the axial chamber 40 via the clearance between the upper valve member 36 and the bore 17 and the slots formed on the surface of the upper valve member 36.

From the position in which the outer valve needle 12 is moved a distance, g, away from the first seating 13, the actuator arrangement may be de-actuated, thereby causing the guide member 42, the outer valve needle 12 and the valve member 36 to move in a downwards direction under the action of the spring forces. On initial downward movement of the outer valve needle 12, the valve member 36 will be forced downwards, thereby reducing the volume of the chamber 25. Thus, fuel pressure in the chamber 25 will increase, until such time as sufficient fuel flows through the clearance between the valve member 36 and the outer valve needle 12 to equalise the fuel pressures in the axial chamber 40 and the chamber 25. Thus, some fuel vents through the clearance during downward movement of the outer valve needle 12. As the valve member 36 moves back against the valve seat 35 the fluid tight seal between the upper valve member 36 and the spring chamber 25 will be reestablished. When the outer valve needle 12 has moved back into the first seating 13, fuel injection is terminated.

In order to achieve fuel injection at a greater rate, from a position in which injection occurs through the first outlet opening 14, the guide member 42 and the outer valve needle 12 may be lifted by a further distance causing the step 27 to engage the enlarged upper end 20*a* of the inner valve needle 20, thereby transmitting movement of the outer valve needle 12 to the inner valve needle 20. This causes the inner valve needle 20 to move away from the second seating 22, thereby exposing the second outlet opening 24. The rate of fuel injection is therefore increased. Upward movement of the valve member 36 through a distance equal to clearance gap, d, will cause the upper surface of the upper valve member 36 to engage the step 37 defined by the bore 43 and upward movement of the valve member 36 ceases. The clearance gap, d, therefore limits the extent of upward movement of the valve member 36 away from the valve seating 35.

The valve member 36 provides a means of venting the chamber 25 during the fuel injecting cycle. As fuel does not remain trapped within the chamber 25 throughout fuel injector operation the effects of fuel degradation are minimised. The amount of fuel which flows from the spring chamber 25 to the axial chamber 40 is determined by the fuel pressure difference between the two chambers 25,40, the length of time that the pressure difference is maintained and the fuel flow area through which the fuel flows. The fuel flow area may be increased by including further flats or slots on the surface of the valve member 36. The fuel pressure difference and the length of time that the fuel pressure difference is maintained are determined by the operating conditions and the type of actuator arrangement use to control movement of the guide member 42. If a piezoelectric actuator arrangement is used, the length of time that the pressure difference is maintained is relatively short. If, however, an electromagnetic actuator arrangement is used then any pressure difference will be maintained for a longer period of time.

The narrow passage 44 at the upper end of the guide member 42 serves to control fuel flow to and from the control chamber (not shown) acting on the upper end surface of the guide member 42 and the axial chamber 40. If this passage is of relatively large diameter then the volume of the axial chamber 40 effectively forms part of the control chamber volume. This increase in volume may adversely effect the rate at which the guide member 42 can be moved. By providing a relatively narrow diameter passage 44 greater control of the movement of the guide member 42 and the upper valve member 36 can be achieved.

Figure 4:
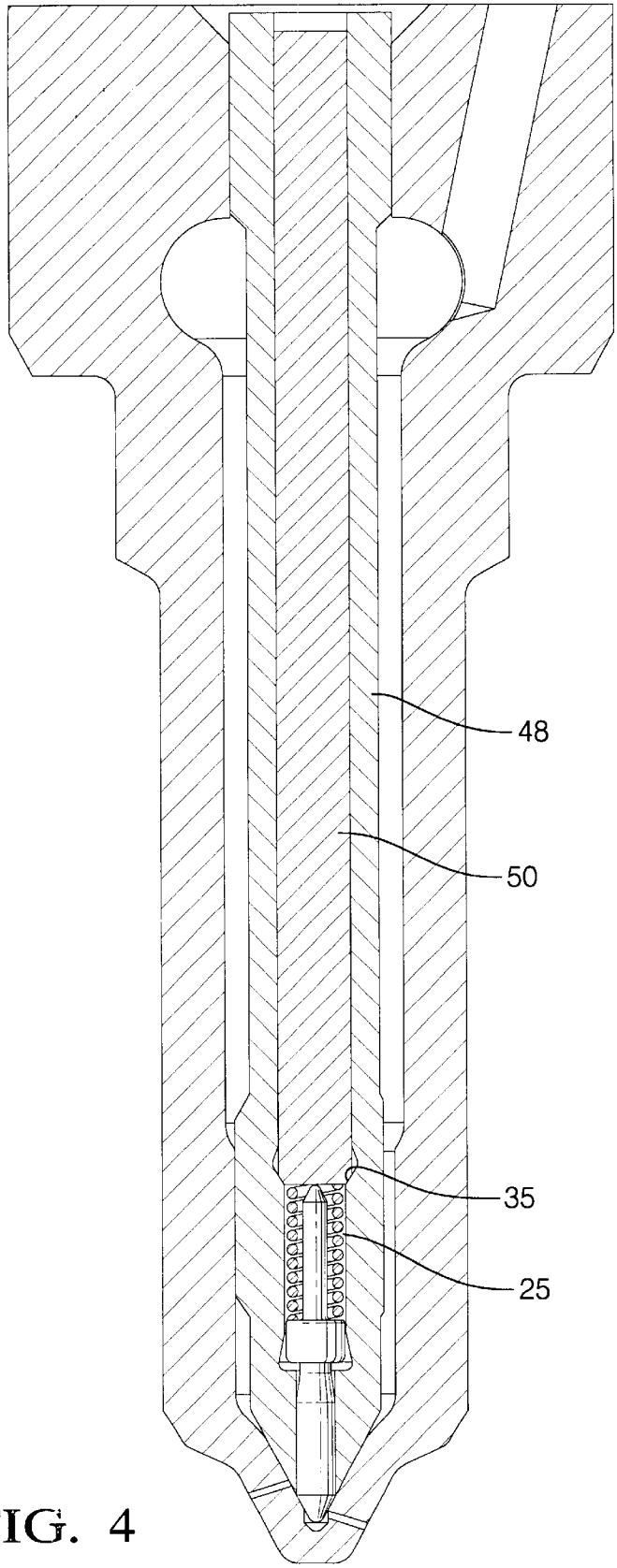

FIG. 4 shows an alternative embodiment of the fuel injector shown in FIG. 3 in which the outer valve needle is extended in length and forms a unitary part 48 with the guide member. In this embodiment, the injector includes an elongated valve member 50, the clearance between the valve member 50 and the outer valve needle 12 therefore extending up to the control chamber (not shown) at the upper end of the arrangement.

Figure 5:
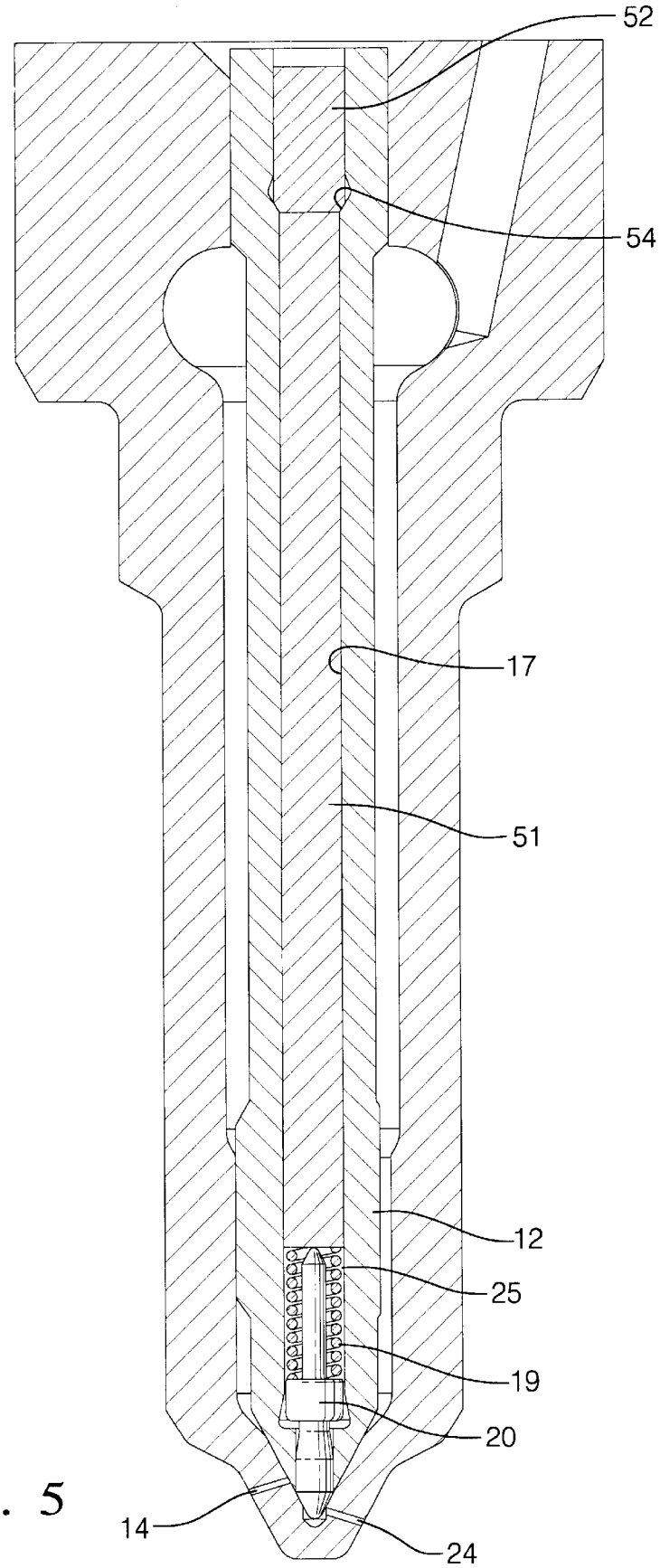

Referring to FIG. 5, a further alternative embodiment of the invention is shown in which a valve member 52 is located towards the upper end of the bore 17 in the outer valve needle 12, the upper valve member 52 being spaced from the chamber 25 by means of a spacer member 51. The upper valve member 52 is engageable with a valve seat 54 spaced apart from the upper end of the outer valve needle 12 by a relatively small amount. The clearance between the spacer member 51 and the bore 17 in the outer valve needle 12 is minimised so that this clearance does not increase significantly the volume of the chamber 25. In FIG. 5, the spacer member 51 is shown as a separate part to the upper valve member 52. However, these two components may form a unitary part. Providing the valve member 52 towards the upper end of the bore 17 in the outer valve member 12 permits the fuel injector to be assembled more easily.

Figure 6:
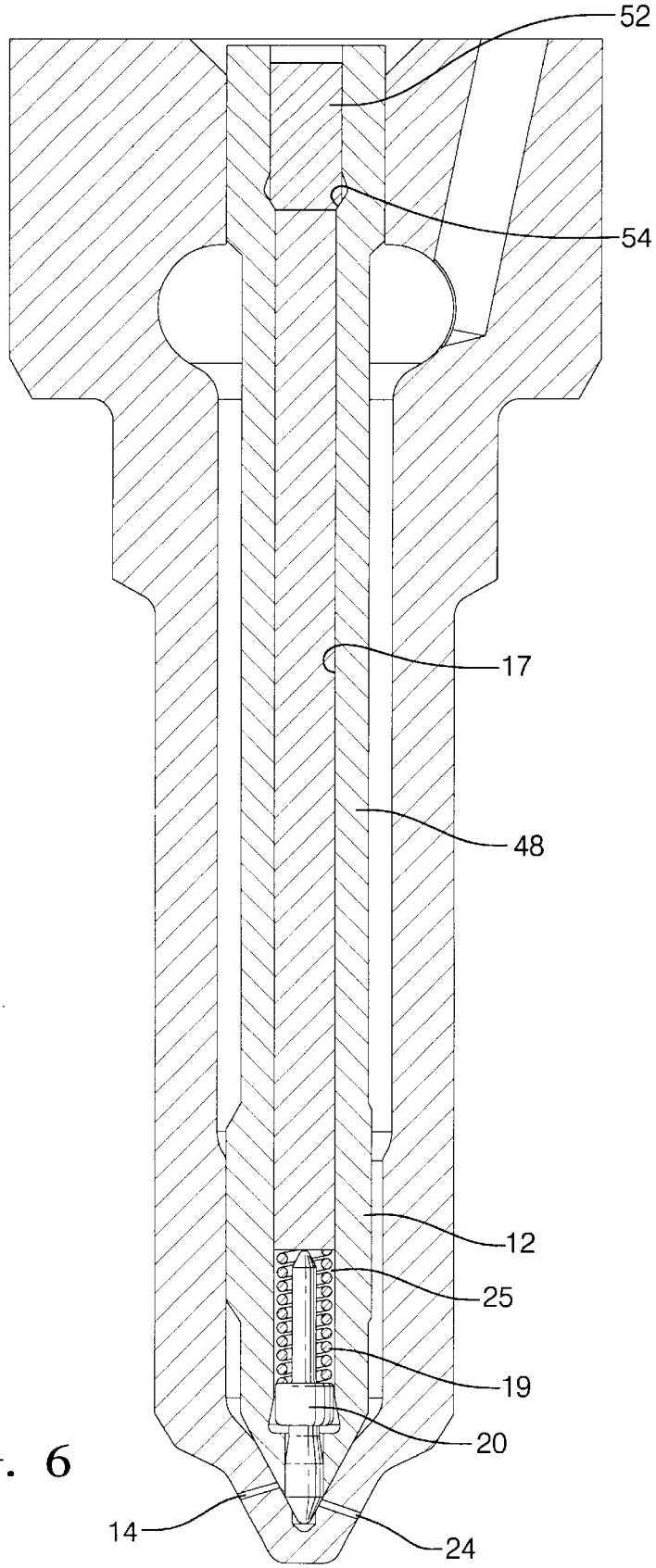

FIG. 6 shows an alternative embodiment to FIG. 5, in which the second outlet opening 24 in the nozzle body 10 is located at a higher axial position on the nozzle body 10 such that, with the inner valve needle 20 in its seated position, the second outlet opening 24 does not communicate with the sac 23. Thus, the second outlet opening 24 is covered by the inner valve needle 20 when fuel injection is not occurring. It is possible to arrange the second outlet opening 24 at a higher axial position in the nozzle body 10 due to the improved concentricity of the outer valve needle 12 and the bore 11 and due to the ability of the elongated outer valve member 48 to sustain larger loads.

Figure 7A:
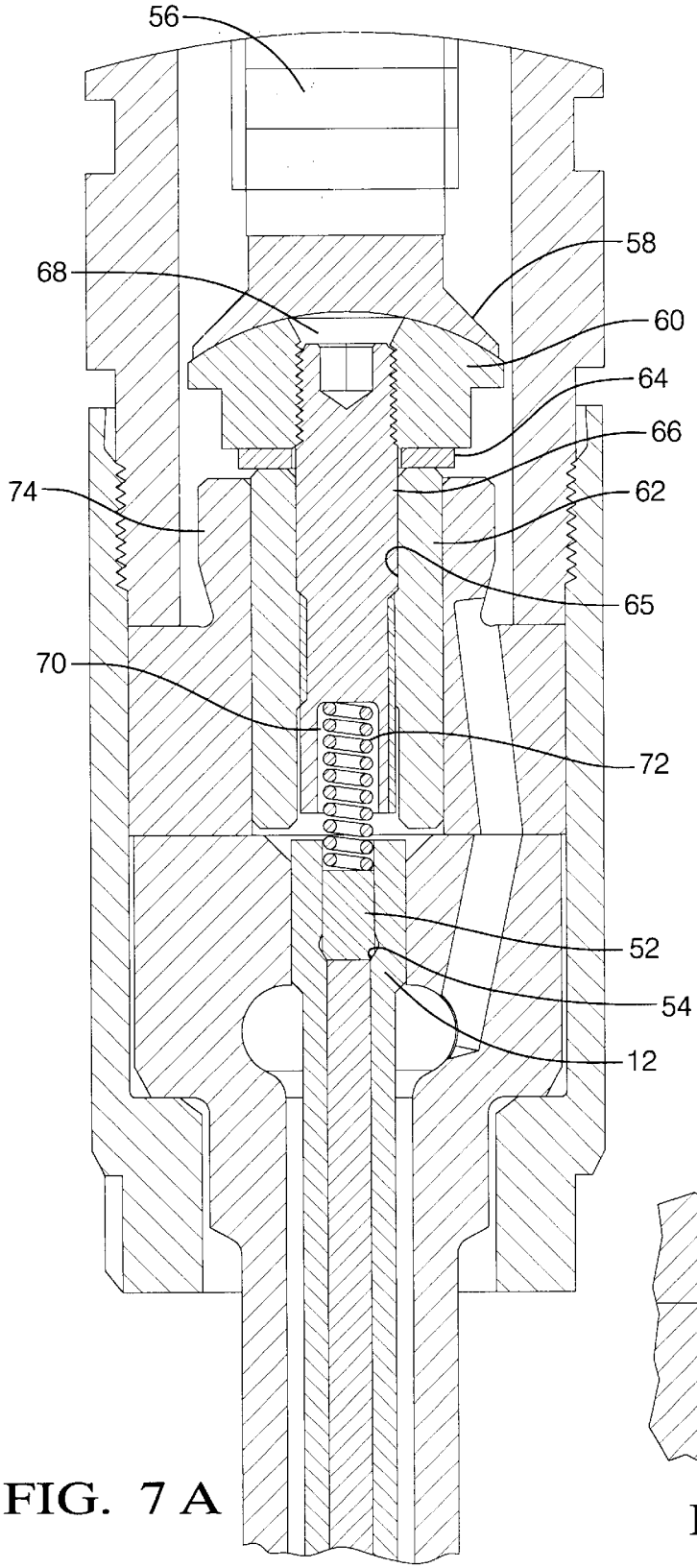
FIG. 7 is an enlarged view of an actuator arrangement which may be used to control valve needle movement in the fuel injector of the present invention.

Referring to FIG. 7*a*, there is shown an actuator arrangement arranged at the upper end of the nozzle body 10 of the fuel injector shown in FIGS. 5 and 6, the actuator arrangement including a piezoelectric stack 56. The lower end of the piezoelectric stack 56 engages a first member 58 having a lower, concave surface. A convex, upper surface of a second member 60 engages the concave lower surface of the first member 58, the second member 60 being spaced from a piston 62 by means of an annular stop member 64. The piston 62 is provided with a bore 65 within which an adjustable member 66 is received. The upper end of the adjustable member 66 is provided with a recess for receiving a screw part 68, which permits the axial position of the adjustable member 66 within the piston 62 to be adjusted. The lower end of the adjustable member 66 is also provided with a bore 70, the blind end of which engages a compression spring 72, the other end of the compression spring 72 engaging the valve member 52 housed within the outer valve needle 12.

When the piezoelectric stack 56 extends in length in a downwards direction, the first member 58 imparts movement to the second member 60, thereby imparting movement to the piston 62 and the adjustable member 66. Movement of the piston 62 in the downwards direction causes movement of the valve member 52 in the downwards direction, thereby compressing the spring 72. Axial movement of the first member 60 is limited by the gap between the lower surface of the stop member 64 and the upper surface of housing part 74. The spring 72 within the recess 70 serves to bias the valve member 52 in a downwards direction against the valve seat 54, thereby maintaining a fluid tight seal between the chamber 25 and the recess 70.

As shown in FIG. 7*a*, the spring 72 may have a relatively small diameter. Alternatively, referring to FIG. 7*b*, a T-shaped member 76 may be provided to transmit movement of the piston 62 to the upper valve member 52. The T-shaped member 76 has a lower surface which engages the upper surface of the valve member 52 and has an upper surface which engages the spring 72. In a further alternative arrangement, the spring 72 may be integrally formed with the valve member 52.

Figure 7B:
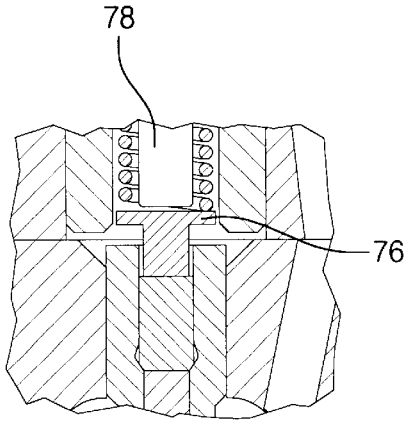

Movement of the valve member 52 in an upwards direction may be limited by means of a spacer member 78, as shown in FIG. 7*b*, or by arranging the spring 72 such that it is compressed totally when the limit of upward movement is reached.

Although in the description hereinbefore, various springs have been referred to as compression springs, it will be appreciated that any other resilient bias arrangements could be used. It will also be appreciated that, if desired, the inner valve needle 20 may itself be provided with a bore within which a further valve needle is slidable to control delivery of fuel through one or more further outlet openings or groups of outlet openings.

What is claimed is:

1. A fuel injector comprising:

a nozzle body having a first bore defining first and second seatings;

an outer valve member, slidable within the first bore and engageable with the first seating to control fuel flow from a first outlet opening located downstream of the first seating, the outer valve member being provided with a through bore, said through bore extending an axial length of the outer valve member and defining a step therein;

an inner valve member, slidable within the through bore and biased against and engageable with the second seating to control fuel flow from a second outlet opening, the inner valve member further including an enlarged region spaced a predefined distance from the step such that when the outer valve member axially translates away from the first seating a distance than the predefined distance, the step engages the enlarged region and unseats the inner valve member from the second seat; and a member disposed in the through bore and extending axially with a first end operatively cooperating with the inner valve member and a second end cooperating with an inner surface of the through bore.

2. The fuel injector as claimed in claim 1, wherein the outer valve member includes a radially extending enlarged region which cooperates with a part of the first bore to guide axial movement of the outer valve member within the first bore such that the outer valve member remains substantially concentric within the first bore throughout axial movement.

3. The fuel injector as claimed in claim 1, wherein said member comprises a sealing member which is received in the upper end of the through bore, the sealing member being in sealing engagement with the through bore to prevent fuel discharge from the through bore through the upper end thereof at undesirable stages in the operating cycle.

4. The fuel injector as claimed in claim 1, comprising a venting arrangement for permitting fuel upstream of the inner valve member to vent from the through bore.

5. The fuel injector as claimed in claim 4, wherein the venting arrangement includes said member, said member comprising an upper valve member slidably mounted within the upper end of the through bore, the through bore defining a valve seat for the upper valve member, whereby fuel pressure within a chamber defined within the through bore between the inner valve member and the upper valve member acts on the upper valve member and whereby movement of the upper valve member away from the valve seat due to fuel pressure within the chamber permits fuel to vent from the chamber.

6. The fuel injector as claimed in claim 5, wherein the upper valve member may be provided with flats or slots to increase the flow area for fuel venting from the chamber.

7. The fuel injector as claimed in claim 5, wherein the upper valve member is provided with resilient bias means to bias the upper valve member into the valve seat.

8. The fuel injector as claimed in claim 5, wherein the upper valve member is spaced apart from the chamber by a spacer member such that the upper valve member is located towards an upper end of the through bore.

9. The fuel injector as claimed in claim 5, wherein an end of the inner valve member extends into a sac region of the injector defined, in part, by a blind end of the first bore.

10. The fuel injector as claimed in claim 9, wherein a narrow clearance is defined between the inner valve member and the outer valve member to permit fuel to flow between the sac region and the chamber.

11. The fuel injector as claimed in claim 9, wherein the second outlet opening communicates with the sac region.

12. The fuel injector as claimed in claim 1, wherein the outer valve member may be provided with a guide member, coaxial with the outer valve member, which serves to guide axial movement of the outer valve member within the first bore.

13. The fuel injector as claimed in claim 12, wherein the guide member is integrally formed with the outer valve member.

14. A method of assembling a fuel injector, said method comprising steps of:

providing a nozzle body having a first bore formed therein;

providing an outer valve member having a through bore extending an axial length thereof, the through bore defining a step therein;

providing an inner valve member having an enlarged region for engagement with the step during valve operation;

inserting the inner valve member in the upper end of the through bore wherein the enlarged region is most proximate to the upper end of the through bore and such that the inner valve member is biased toward the step;

inserting an upper member in the upper end of the through bore having a first end operatively cooperating with the inner valve member and extending axially and a second end cooperating with an inner surface of the through bore; and inserting the outer valve member, having the inner valve member and the upper member inserted therein, into the upper end of the first bore.

15. The fuel injector as claimed in claim 14, wherein the upper member is an upper valve member which permits fuel upstream of the inner valve member to vent from the through bore.

* * * * *